US006296406B1

(12) United States Patent
Kurashina

(10) Patent No.: US 6,296,406 B1
(45) Date of Patent: Oct. 2, 2001

(54) LABEL-MAKING APPARATUS AND METHOD

(75) Inventor: Hiroyasu Kurashina, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/689,407

(22) Filed: Oct. 12, 2000

(30) Foreign Application Priority Data

Oct. 14, 1999 (JP) ..... 11-291926

(51) Int. Cl.[7] ..... B41J 11/26; B41J 3/42

(52) U.S. Cl. ..... 400/615.2; 400/76; 400/70; 400/61

(58) Field of Search ..... 400/615.2, 61, 400/70, 76

(56) References Cited

U.S. PATENT DOCUMENTS 5,222,818 * 6/1993 Akiyama et al. ..... 400/61
5,621,453 * 4/1997 Fujita et al. ..... 347/240
5,741,082 * 4/1998 Toya ..... 400/615.2

FOREIGN PATENT DOCUMENTS 0 473 147 A2 * 3/1992 (EP) .

* cited by examiner

*Primary Examiner*—John S. Hilten
*Assistant Examiner*—Charles H. Nolan, Jr.
(74) *Attorney, Agent, or Firm*—Hogan & Hartson L.L.P.

(57) ABSTRACT

There is provided a label-making apparatus and method that is capable of making a label with an accurate length depending on a situation before and after printing. The label-making apparatus is capable of printing an entered character string on a tape as a printing medium while advancing the tape. After printing the character string on the tape, the label-making apparatus cuts the tape to a length set beforehand at a predetermined cutting position, thereby making a label. In response to a non-printing feed instruction which instructs non-printing feed of the tape, feed of the tape is carried out without printing thereon to advance the tape by a predetermined length.

14 Claims, 6 Drawing Sheets

LABEL-MAKING APPARATUS AND METHOD

BACKGROUND OF THE INVENTION

1. Field of the Invention

This invention relates to a label-making apparatus and method for producing a label by cutting a tape as a printing medium.

2. Prior Art

Recently, there have been proposed label-making apparatuses that are capable of printing at least one character string comprised of characters, such as letters, symbols, and images (including a character(a space or the like) representative of a blank), which are normally input to the apparatus as desired, while feeding a tape rolled out from a tape cartridge. The tape is held in the tape cartridge in a state wound into a roll. The label-making apparatuses create a label by cutting off the tape to a length set beforehand. More specifically, in these label-making apparatuses, not only printing of a character string but also feed of a label (tape) is carried out, and the label having a desired length is produced by cutting off a printed portion of the tape automatically or manually. The length of feed of the label and a position for cutting off the label are determined according to a label length set by a user, and when they are determined, it is assumed that before the tape is printed, a leading edge of the tape is placed just at the position of a cutter (see FIG. 6A). For instance, when a label having a length of 50 is desired to be produce the tape is advanced by 50 mm, and cut off to form the label.

In the above label-making apparatuses, however, when the tape cartridge holding the tape therein is mounted, if the leading edge of the tape is advanced past the position of the cutter (see FIG. 6B), or inversely if the leading edge of the tape is withdrawn inward of the cartridge (see FIG. 6C), it is impossible to produce a label with a desired length by printing the tape as it is (as shown in the figures, e.g. when the user desires to produce a label having a length of 50 mm, a label with a length of $(50+\alpha)$ mm is formed in the former case, while in the latter case, a label with a length of $(50-\beta)$ mm is produced).

SUMMARY OF THE INVENTION

It is an object of the invention to provide a label-making apparatus and method which is capable of producing a label with an accurate length depending on a situation before and after printing.

To attain the above object, according to a first aspect of the invention, there is provided a label-making apparatus that is capable of printing an entered character string on a tape as a printing medium while advancing the tape, wherein after printing the entered character string on the tape, the label-making apparatus cuts the tape to a length set beforehand at a predetermined cutting position, thereby making a label.

The label-making apparatus according to the first aspect of the invention is characterized by comprising:

printing means for printing on the tape;

tape feed means for feeding the tape;

non-printing feed instruction means for instructing non-printing feed of the tape; and control means responsive to a non-printing feed instruction issued by the non-printing feed instruction means, for controlling operation of the printing means and operation of the tape feed means, such that the printing means is not driven but only the tape feed means is driven to advance the tape by a predetermined length.

To attain the above object, according to a second aspect of the invention, there is provided a label-making method for printing an entered character string on a tape as a printing medium while advancing the tape, and cutting the tape to a length set beforehand at a predetermined cutting position after printing the entered character string on the tape, to thereby make a label.

The label -making method according to the second aspect of the invention is characterized in that when a non-printing feed instruction which instructs non-printing feed of the tape is issued, the non-printing feed of the tape is carried out by only feeding the tape to advance the tape by a predetermined length without carrying out printing of the tape.

According to this label-making apparatus and method, when a leading edge of the tape to be printed is positioned short of the cutting position, in other words, when a label with a length shorter than a length set beforehand would be produced if the tape were printed and cut without further processing, a non-printing feed of the tape is carried out to advance the tape by a predetermined length until the leading edge of the tape is advanced past the cutting position (the non-printing feed operation is repeated a plurality of times if the leading edge is not advanced to a position past the cutting position by a single operation), whereby the leading edge of the tape can be fed to the cutting position. Further, in spite of limitation of configurable settings of lengths of the front and rear margins of a label, if the user wants to set a margin longer than the maximum length permitted by the construction of the apparatus, or even if the front and rear margins of a label can be set only to the same length, it is possible to provide leading and trailing margins with desired lengths by carrying out the non-printing feed by the predetermined length.

It should be noted that throughout the specification the term "character string" is used to mean a character string comprised of at least one character, such as a letter, a symbol, or an image, which is normally input to the apparatus. Further, it is assumed that a character (a space or the like) representative of a blank is also included in the above character.

To attain the above object, according to a third aspect of the invention, there is provided a label-making apparatus that is capable of printing an entered character string on a tape as a printing medium while advancing the tape, wherein after printing the entered character string on the tape, the label-making apparatus cuts the tape to a length set beforehand at a predetermined cutting position, thereby making a label.

The label-making apparatus according to the third aspect of the invention is characterized by comprising:

printing means for printing on the tape;

tape feed means for feeding the tape;

cutting means for cutting the tape;

non-printing feed/cutting instruction means for instructing non-printing feed and cutting of the tape; and control means responsive to a non-printing feed/cutting instruction issued by the non-printing feed/cutting instruction means, for controlling operation of the printing means, operation of the tape feed means, and operation of the cutting means, such that the printing means is not driven but the tape feed means is driven to advance the tape by a predetermined length, and then the cutting means is driven to cut the tape.

To attain the above object, according to a fourth aspect of the invention, there is provided a label-making method for printing an entered character string on a tape as a printing medium while advancing the tape, and cutting the tape to a length set beforehand at a predetermined cutting position after printing the entered character string on the tape, to thereby make a label.

The label-making method according to the fourth aspect of the invention is characterized in that when a non-printing feed/cutting instruction which instructs non-printing feed and cutting of the tape is issued, the non-printing feed of the tape is carried out by only feeding the tape to advance the tape by a predetermined length without carrying out printing of the tape, and the cutting of the tape is carried out to cut the tape.

According to this label-making apparatus and method, when a leading edge of the tape to be printed is positioned short of the cutting position, in other words, when a label with a length shorter than a length set beforehand would be produced if the tape were printed and cut without further processing, it is possible to advance the tape by a predetermined length through the non-printing feed and cut the tape. This makes it possible to set the leading edge of the tape just at the cutting position, and thereby produce a label having an accurate length as the user desires. Further, even when a leading end portion of the tape can not be used because it is discolored or damaged after the tape has been left for a long time period, it is possible to advance the unusable portion for cutting. Furthermore, a plain label with a predetermined length can be produced as a substitute for an adhesive cellophane tape or a tag.

To attain the above object, according to a fifth aspect of the invention, there is provided a label-making apparatus that is capable of printing an entered character string on a tape as a printing medium while advancing the tape, wherein after printing the entered character string on the tape, the label-making apparatus cuts the tape to a length set beforehand at a predetermined cutting position, thereby making a label, The label-making apparatus according to the fifth aspect of the invention is characterized by comprising:

printing means for printing on the tape;

tape feed means for feeding the tape;

cutting means for cutting the tape;

instruction means capable of selectively issuing one of a non-printing feed instruction which instructs non-printing feed of the tape, a non-printing feed/cutting instruction which instructs non-printing feed and cutting of the tape, and a cutting instruction which instructs cutting of the tape; and control means responsive to a selectively issued one of the non-printing feed instruction, the non-printing feed/cutting instruction, and the cutting instruction, for controlling operation of the tape feed means, operation of the printing means, and operation of the cutting means, such that when the non-printing feed instruction is received, the printing means is not driven but only the tape feed means is driven to advance the tape by a predetermined length; when the non-printing feed/cutting instruction is received, the printing means is not driven but the tape feed means is driven to advance the tape by a predetermined length and the cutting means is driven to cut the tape; and when the cutting instruction is received, neither the printing means nor the tape feed means is driven, but only the cutting means is driven to cut the tape.

To attain the above object, according to a sixth aspect of the invention, there is provided a label-making method for printing an entered character string on a tape as a printing medium while advancing the tape, and cutting the tape to a length set beforehand at a predetermined cutting position after printing the entered character string on the tape, to thereby make a label.

The label-making apparatus according to the sixth aspect of the invention is characterized in that in response to a selectively issued one of a non-printing feed instruction which instructs non-printing feed of the tape, a non-printing feed/cutting instruction which instructs non-printing feed and cutting of the tape, and a cutting instruction which instructs cutting of the tape, when the non-printing feed instruction is issued, the non-printing feed of the tape is carried out by only feeding the tape to advance the tape by a predetermined length without carrying out printing of the tape; when the non-printing feed/cutting instruction is issued, the non-printing feed of the tape is carried out by only feeding the tape to advance the tape by a predetermined length without carrying out printing of the tape, and the cutting of the tape is carried out to cut the tape; and when the cutting instruction is issued, neither the printing of the tape nor the feed of the tape is carried out, but only the cutting of the tape is carried out to cut the tape.

According to this label-making apparatus and method, it is possible to select one of a control mode for carrying out only the non-printing feed, a control mode for effecting both the non-printing feed and the cutting operation, and a control mode for performing only the cutting operation. Therefore, in addition to merits obtained by the control modes described of the first to fourth aspects of the invention, there is an advantage that the control mode for performing only the cutting operation can be selected. For instance, if a leading edge of the tape has been rolled out forward of the cutting position before printing, in other words, if a label with a length longer than a length set beforehand would be produced if the tape were printed and cut without further processing, the control mode for performing only the cutting operation can be selected to cut the portion of the tape forward of the cutting position beforehand. This makes it possible to set the leading edge of the tape just at the cutting position, and thereby produce a label with an accurate length as the user desires.

The above and other objects, features, and advantages of the invention will become more apparent from the following detailed description taken in conjunction with the accompanying drawings.

DETAILED DESCRIPTION

Figure 1:
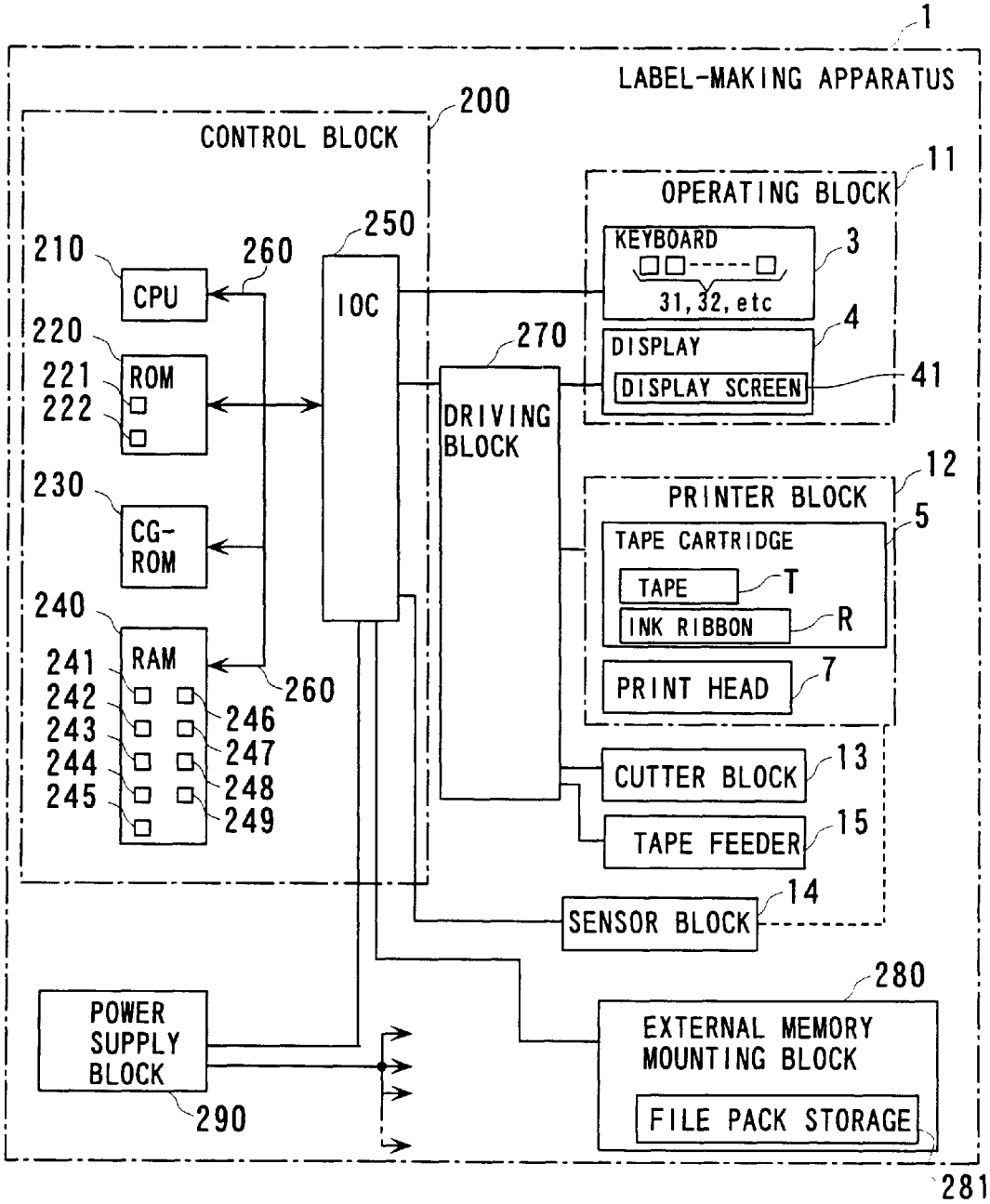
FIG. 1 is a block diagram showing the arrangement of a control system of a label-making apparatus according to an embodiment of the invention.

Next, a label-making apparatus and method according to an embodiment of the invention will be described in detail with reference to the drawings. FIG. 1 is a block diagram of a control system of the label-making apparatus.

The label-making apparatus 1 is capable of carrying out color printing of a print image on a tape T by a thermal printing method as well as cutting off the printed portion of the tape T to produce a label. The print image is formed based on desired letters and the like entered via a keyboard of the apparatus 1.

The tape T is comprised of a substrate tape, an adhesive layer coated on an underside surface of the substrate tape, and a release paper tape affixed to the adhesive layer. The substrate tape is formed of a material which is capable of readily absorbing ink, such as paper, paper with a coated layer or a film with a coated layer. The adhesive layer is used for affixing a printing tape as a label to an object article, such as a file, while the release paper tape is used for preventing dust or dirt from depositing on the adhesive layer. Tape cartridges are provided which contain various kinds of tapes T with various tape widths of 4.5 mm to 48 mm. A print image having a resolution of 24 to 1024 dots in the direction of the width of the tape is printed on the tape T, dependent on the width thereof. It should be noted that there are provided still other tapes T different in material or having background colors other than white. Therefore, it is possible to use at least several tens of kinds of tapes T including ones to be adopted in the future.

As shown in FIG. 1, the label-making apparatus 1 is basically comprised of an operating block 11 which includes the keyboard 3 and a display 4 and provides interface between the apparatus land the user, a printer block 12 which includes a tape cartridge 5 removably mounted in the apparatus 1, and a print head 7 of a thermal type, and prints on a tape T fed from the tape cartridge 5 by the print head 7, a cutter block 13 for cutting off the printed portion of the tape T, a sensor block 14 having various sensors for carrying out various detecting operations, a tape feeder 15, a driving block 270 having various drivers for driving circuits of blocks and devices, an external memory-mounting block 280 for removably mounting an external memory 281 (called "file pack storages") therein, a power supply block 290, and a control block 200 for controlling operations of components of the label-making apparatus 1 including the above-mentioned sensors and drivers. To implement the above construction, the apparatus 1 contains a circuit board, not shown, in addition to the printer block 12, the cutter block 13, the sensor block 14, the tape feeder 15, the external memory-mounting block 280, and so forth. On the circuit board are mounted the power supply block 290 and the circuits of the driving block 270 and the control block 200. A power supply unit of the power supply block 290 is connected to a connector socket 24 connectable with an AC adapter, and a battery, such as a nicad battery, removably mounted from the outside of the apparatus, so as to supply power to the components of the label-making apparatus 1.

Although detailed illustration and indication of each component are omitted, the printer block 12 has the tape cartridge 5 containing the tape T and an ink ribbon R within a cartridge casing. The tape cartridge 5 has a through hole for receiving therein a head unit arranged in a compartment of the printer block. The tape cartridge 5 contains a tape reel for receiving therein a positioning pin arranged in the compartment, and a ribbon take-up reel for receiving therein a ribbon take-up reel-driving shaft arranged in the compartment. Further, a platen roller for receiving therein a platen drive shaft arranged in the compartment is arranged within the tape cartridge at a location corresponding to the print head (thermal head) 7 incorporated in the head unit, where the tape T and the ink ribbon R overlap.

The tape cartridge 5 has a plurality of small holes formed in the bottom thereof for discrimination of the type of tape T contained therein from the other types of the tape T having different widths, which are contained in other tape cartridges 5. A tape-discriminating sensor, not shown, comprised e.g. of micro-switches is arranged in the compartment, for detecting these holes to thereby determine the type of tape T contained in the tape cartridge. Further, the compartment is provided with an ambient temperature sensor, such as a thermistor, which sends information of an ambient temperature detected thereby to the control block 200. Further, a head surface temperature sensor formed e.g. by a thermistor, is arranged on a surface of the print head 7 in a manner intimately contacting the surface, which sends information of the surface temperature of the thermal head 7 detected thereby to the control block 200. The apparatus casing is formed with a tape exit which communicates between the compartment and the outside of the apparatus. On the tape exit faces a tape cutter for cutting off a dispensed portion of the tape T.

When the tape cartridge 5 is mounted in the compartment, the through hole of the tape cartridge 5 receives therein the head unit, the tape reel receives therein the positioning pin, the platen roller receives therein the platen drive shaft, and the ribbon take-up reel receives therein the ribbon take-up reel drive shaft, which enables the feed of the tape T and the ink ribbon R. Further, in the above state, the print head 7 is brought into contact with the platen roller in a manner sandwiching the tape T and the ink ribbon R therebetween, whereby the apparatus is ready for a printing operation. When the tape T is rolled out from the tape reel, the ink ribbon R is also rolled out from the ribbon reel and fed or run together with the tape T in a state lying upon the tape T, followed by being taken up by the ribbon take-up reel. That is, the platen roller and the ribbon take-up reel are rotated in synchronism with each other, whereby the tape T and the ink ribbon 18 are simultaneously fed, and at the same time the print head 7 is driven in synchronism with running of the tape T and the ink ribbon R to thereby carry out printing.

In the label-making apparatus 1, the user, after mounting the tape cartridge 5 in the compartment of the printer block 12, enters printing information of print images, such as desired characters (letters, numerals, symbols, figures and the like), via the keyboard 3, and at the same time confirms or views results of the entry on the display 4 for editing the same. Thereafter, when the user instructs a printing operation via the keyboard 3, the printer block 12 and the tape feeder 15 are driven to unwind the tape T from the tape cartridge 5, and at the same time the print head 7 is driven to print the desired characters on the tape T. The printed portion of the tape T is delivered from the tape exit, as the printing operation proceeds. After the desired characters have been printed in the above manner, the platen roller continues to rotate for a predetermined time period (the ribbon take-up reel also continues to rotate in synchronism with rotation of the platen roller), whereby the tape T continues to be fed until a predetermined cutting position on the tape T, which is adapted to a tape length including the length of a marginal area, reaches a point corresponding to a location of the tape cutter.

The tape feeder 15 is arranged in a space extending from a lateral side of the compartment to a bottom side of the same, and rotates the platen drive shaft and the ribbon take-up reel drive shaft by using a tape feed motor (TF motor) arranged as a power (drive) source at a location laterally outward of the compartment. The tape feeder 15 includes the TF motor, the platen drive shaft, the ribbon take-up reel drive shaft, a reduction gear train for transmitting part of the driving force of the TF motor to each of the drive shafts, and a chassis for supporting them thereon.

Further, the TF motor according to the present embodiment is implemented by a DC motor, and the tape feeder 15 further includes an encoder for detecting the number of rotations of the TF motor (DC motor). The encoder is comprised of a disk, not shown, which is formed with four detection openings along a periphery thereof and rigidly fixed to an end of the main shaft of the DC motor, and a rotational speed sensor, not shown, which is comprised of a photo sensor which faces the detection openings of the disk, and a sensor circuit board supporting the photo sensor thereon and carries out photoelectric conversion in cooperation with the photo sensor. The photo sensor has a light-emitting element and a light-receiving element arranged in a manner opposed to each other. Light emitted from the light-emitting element passes through the detection openings (arranged along the periphery of the disk) of the encoder and is received by the light-receiving element whereby the number of rotations of the DC motor is detected (the number of pulses corresponding to the number of turns of the DC motor is generated). In other words, the on-off of the light received from the light-emitting element by the light-receiving element is photoelectrically converted by the sensor circuit board and output as a pulse signal to the control block 200. Of course, the above TF motor can also be constructed by a stepping motor (pulse motor) to omit the encoder such that the tape T can be fed with ease by a predetermined number of steps based on the pulse signal.

In FIG. 1, for convenience of description, it is assumed that the sensor block 14 includes the tape-discriminating sensor, the ambient temperature sensor, the head surface temperature sensor, and the rotational speed sensor, described hereinabove. The sensor block 14 delivers signals indicative of the sensed type of a tape, ambient temperature, head surface temperature, and rotational speed, generated by the respective sensors, to the control block 200. It should be noted that the sensor block 14 can be provided with other sensors, such as a voltage sensor which is connected to the power supply unit of the power supply block 290 that supplies power to the components of the label-making apparatus 1, for detecting changes in the electric potential of the power supply unit, and the like, or some of the above sensors, such as the encoder in the case of the TF motor being the pulse motor, can be omitted to suit the actual requirements of the apparatus.

Next, the cutter block 13 includes a cutter and a cutter motor for driving the cutter for cutting operations. When the tape T is cut automatically, the tape T is further sent by the length of a rear margin after completion of the printing operation, and then stopped, whereupon the cutter motor is driven to cut off the tape T. It should be noted that the label-making apparatus 1 is provided with a cut key for enabling the user to manually cut the tape by key stroke, and it is possible to switch between an automatic cutting mode and a manual cutting mode. In the manual cutting mode, when the printing operation and additional feed of the tape are completed, the user depresses the cut key, whereby the cutter is actuated, and the tape T is cut off into a desired length to produce a label.

The driving block 270 includes a display driver, a head driver, and a motor driver. The display driver drives the display 4 of the operating block 11 in response to control signals delivered from the control block 200, i.e. in accordance with commands carried by the signals. Similarly, the head driver drives the print head 7 of the printer block 12 in accordance with commands from the control block 200. Further, the motor driver has a TF motor driver for driving the TF motor of the tape feeder 15, and a cutter motor driver for driving the cutter motor of the cutter block 13, and drives each motor in accordance with commands from the control block 200.

Next, according to the label-making apparatus 1, the user can removably mount the external memory (hereinafter referred to as the "file pack storage") 281 which is capable of storing data of a lot of document files and the like, as an auxiliary memory for use with a RAM 240, described hereinafter. The file pack storage 281 contains one or a plurality of (e.g. two) SRAMs (static RAMs), and is backed-up by batteries or the like, such that stored data can be preserved even when the file pack storage 281 is removed from the label-making apparatus 1. Further, when the file pack storage 281 is mounted in a compartment of the external memory-mounting block 280, the file pack storage works such that it appears to the user to be part (e.g. one directory) of a memory area of the RAM 240, and is employed as a work area for carrying out control operations.

The operating block 11 includes the keyboard 3 and the display 4. The display 4 has a display screen 41 which is capable of displaying display image data e.g. of 198×64 dots on a rectangular display area of approximately 8 cm in the horizontal direction (X direction)×4 cm in the vertical direction (Y direction). The display 4 is used by the user when he enters data via the keyboard 3 to form or edit matrix data representative of a character string image having characters, such as letters, numerals, symbols, simple figures, etc., (hereinafter generically referred to as "characters") arranged therein or a print image including the character string image, view the resulting data, and enter various commands including option-selecting commands via the keyboard 3.

On the keyboard 3, there are arranged a character key group 31 including an alphabet key group, not shown, a symbol key group (including a space key), not shown, a number key group, not shown, and a nonstandard character key group, not shown, for calling nonstandard characters for selection, as well as a function key group 32 for designating various operation modes. In a type of the apparatus 1 (Japanese language-adapted type) which is capable of entering the Japanese language, there is also provided a kana key group, not shown, for entering Japanese hiragana letters and Japanese katakana letters.

The function key group 32 includes a power key, not shown, a print key, not shown, for instructing a printing operation, a selection key, not shown, for finally determining entry of character data and starting new lines during text entry as well as determining selection of one of the various operating modes on a corresponding one of the selection screens, a color specification key, not shown, for specifying printing colors including neutral colors (mixed colors) of print image data, a color-setting key, not shown, for setting colors of characters and background colors, and four cursor keys (up arrow key, down arrow key, left arrow key, and right arrow key), not shown, for moving the cursor or the display range of print image data on the display screen 41 in respective upward, downward, leftward, and rightward directions.

The function key group 32 also includes a cancel key, not shown, for canceling instructions, a shift key, not shown, for use in changing roles of respective keys as well as modifying registered image data, an image key, not shown, for alternately switching between a text entry screen or a selection screen and a display screen (image screen) for displaying print image data, a proportion-changing (zoom) key, not shown, for changing a proportion between the size of print image data and the size of display image data displayed on the image screen, a style key, not shown, for setting styles of labels to be formed, a file key, not shown, for handling files, an illustration key, not shown, for selecting background images, a nonstandard character registration key, not shown, for registering nonstandard characters, a conversion key, not shown, for carrying out conversion operations, such as kana-kanji conversion (in the case of the Japanese language-adapted type of the apparatus), a pack key, not shown, for initialization of the file pack storage 281 or changing the settings thereof, a format key, not shown, for setting a format for printing background patterns, a special print key, not shown, for setting a special print format for carrying out continuous printing, enlarged printing, mirrored character printing, and the like, and anon-printing feed/cutting key, not shown, for selectively setting one of a non-printing feed control mode, a cutting control mode, and a non-printing feed & cutting control mode, which will be described in detail hereinafter.

Similarly to keyboards of the general type, the above key entries may be made by separate keys exclusively provided for respective key entries and/or by a smaller number of keys operated in combination with the shift key or the like. Here, for purposes of ease of understanding, the following description will be made assuming that there are provided as many keys as described above.

As shown in FIG. 1, from the keyboard 3, various commands and data described above are input to the control block 200.

The control block 200 includes a CPU 210, a ROM 220, a character generator ROM (CG-ROM) 230, a RAM 240, and an input/output control circuit (IOC) 250, all of which are connected to each other by an internal bus 260.

The ROM 220 has a control program area 221 storing control programs executed by the CPU 210 as well as a control data area 222 storing control data including a color conversion table, a character modification table, and the like. The CG-ROM 230 stores font data, i.e. data defining characters, symbols, figures and the like, provided for the label-making apparatus 1. When code data identifying a character or the like is input thereto, it outputs the corresponding font data. In the case of the Japanese language-adapted type, the control data area 222 also stores a kana-kanji conversion table for converting Japanese hiragana letters into corresponding Japanese kanji letters.

The RAM 240 is backed-up such that stored data items can be preserved even when the power is turned off by operating the power key. The RAM 240 includes areas of a register group 241 for storing values of flags, etc., a text data area 242 for storing text data of characters or the like entered by the user via the keyboard 3, a display image data area 243 for storing image data displayed on the display screen 41, a print image data area 244 for storing print image data, a registered image data area 245 for storing registered image data, a nonstandard character registration image data area 246 for storing nonstandard character registration image data, a background image data area 247 for storing background image data as options for background images and character color data corresponding thereto, and buffer areas 248 including a character image-forming buffer, a character conversion buffer, buffers for providing respective separate dithered image matrices of basic colors, a print buffer, and so forth. The RAM 240 is used as a work area for carrying out the control operations.

The IOC 250 incorporates a logic circuit for complementing the functions of the CPU 210 as well as dealing with interface signals for interfacing between the CPU 210 and peripheral circuits. The logic circuit is comprised of gate arrays, and custom LSI's. The IOC 250 also incorporates the function of a timer for measuring elapsed time. The IOC 250 is connected to the sensors of the sensor block 14 and the keyboard 3, for receiving the signals generated by the sensor block 14 as well as commands and data entered via the keyboard 3, and inputting these to the internal bus 260 directly or after processing them. Further, the IOC 250 cooperates with the CPU 210 to deliver data and control signals input to the internal bus 260 by the CPU 210 or the like, to the driving block 270 directly or after processing them.

Further, the IOC 250 is connected to the external memory-mounting block 280 to control the input and output of data apparently carried out by accessing the RAM 240 but actually carried out by accessing the file pack storage 281, whereby when the file pack storage 281 is mounted in the compartment of the external memory-mounting block 280, the IOC 250 carries out control operations such that the RAM 240 appears to be expanded (the memory capacity of the RAM 240 appears to be increased) to the user (in handling files and the like). Therefore, in the following, unless otherwise specified, description is made assuming that the RAM 240 includes a memory capacity of the file pack storage 281, and that data stored in the file pack storage 281 is stored in the RAM 240 (although shown as the file pack storage 281 in FIG. 1 for purposes of clarity, actually, part or all of each of the above areas can be shared with the file pack storage 281).

The CPU 210 of the control block 200 receives the signals and data from the components of the label-making apparatus 1 via the IOC 250, according to the control program read from the ROM 220, processes font data from the CG-ROM 230 and various data stored in the RAM 240 (including the file pack storage 281, as described above), and delivers signals and data to the components of the label-making apparatus 1 via the IOC 250 to thereby carry out position control during printing operations, display control of the display screen 41, and print control that causes the print head 7 to carry out printing on the tape T under predetermined printing conditions. In short, the CPU 210 controls the overall operation of the label-making apparatus 1.

Figure 2:
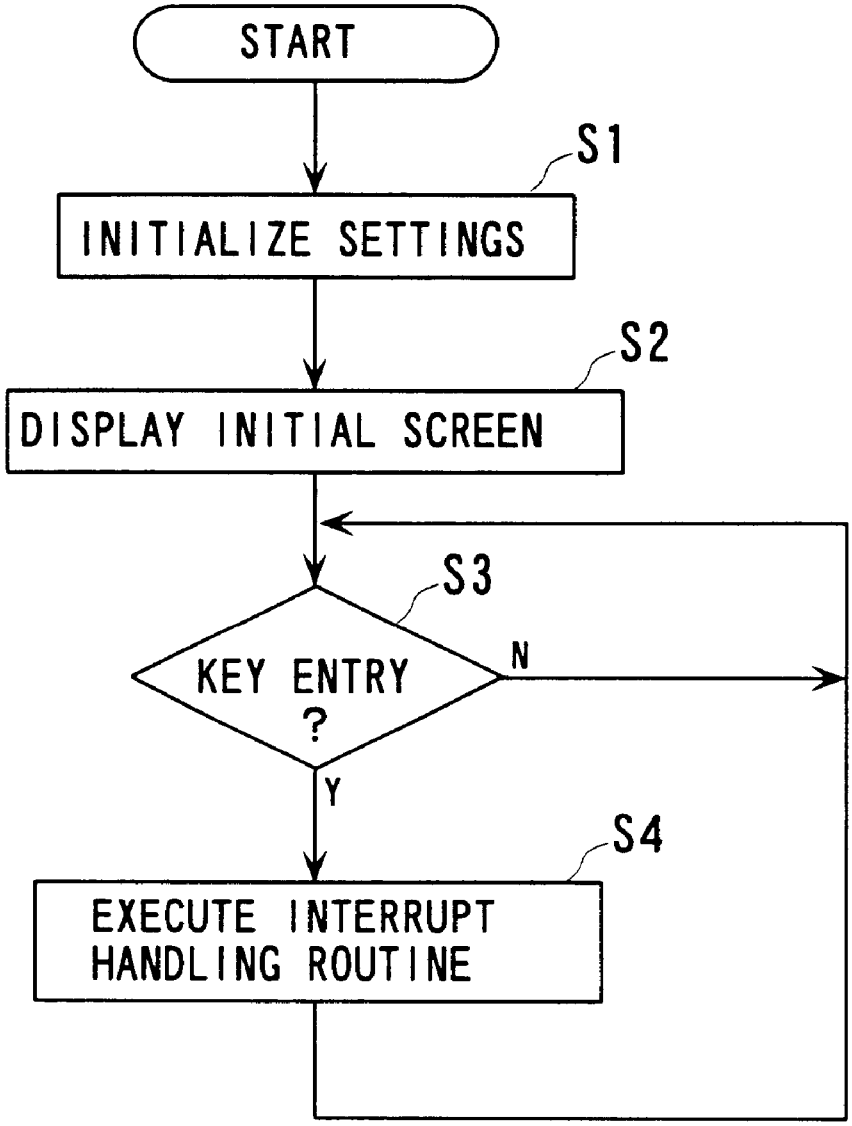
FIG. 2 is a flowchart showing a conceptual representation of an overall control process executed by the FIG. 1 label-making apparatus.

Next, the overall control process carried out by the label-making apparatus 1 will be described with reference to FIG. 2. As shown in the figure, when the program for carrying out the control process is started e.g. when the power key is depressed (the power of the label-making apparatus 1 is turned on), first, at step S1, initialization of the system including restoration of saved control flags is carried out to restore the label-making apparatus 1 to the state it was in before the power was turned off the last time. Then, the image that was displayed on the display screen 41 before the power was turned off the last time is shown as an initial screen at step S2. The following steps in FIG. 2, that is, step S3 for determining whether or not a key entry has been made and step S4 for carrying out an interrupt handling routine are conceptual representations of actual operations. Actually, when the initial screen has been displayed at step S2, the label-making apparatus 1 enables an interrupt by key entry (keyboard interrupt), and maintains the key entry wait state (No to S3) until a keyboard interrupt is generated. When the keyboard interrupt is generated (Yes to S3), a corresponding interrupt handling routine is executed at step S4, and after the interrupt handling routine is terminated, the key entry wait state is again enabled and maintained (No to S3).

As described above, in the label-making apparatus 1, main processing operations by the apparatus are carried out by interrupt handling routines, and hence if print image data for printing is provided or has been prepared, the user can print a print image based on the print image data at a desired time point, by depressing the print key to thereby generate an interrupt by the print key and start a printing process. In short, an operating procedure before the printing operation can be selected by the user as he desires.

In a narrow sense, the terms "display image" and "print image" mean a displayed image itself and a printed image itself, respectively, and the apparatus 1 deals with display image data representative of a display image and print image data representative of a print image. That is, although in the apparatus 1, an object to be processed, i.e. formed, modified, or registered (recorded) is image data but not an image itself, for simplicity of the following description, "image data representative of ~ image" is referred to as "~ image", similarly to the image itself.

Figure 3:
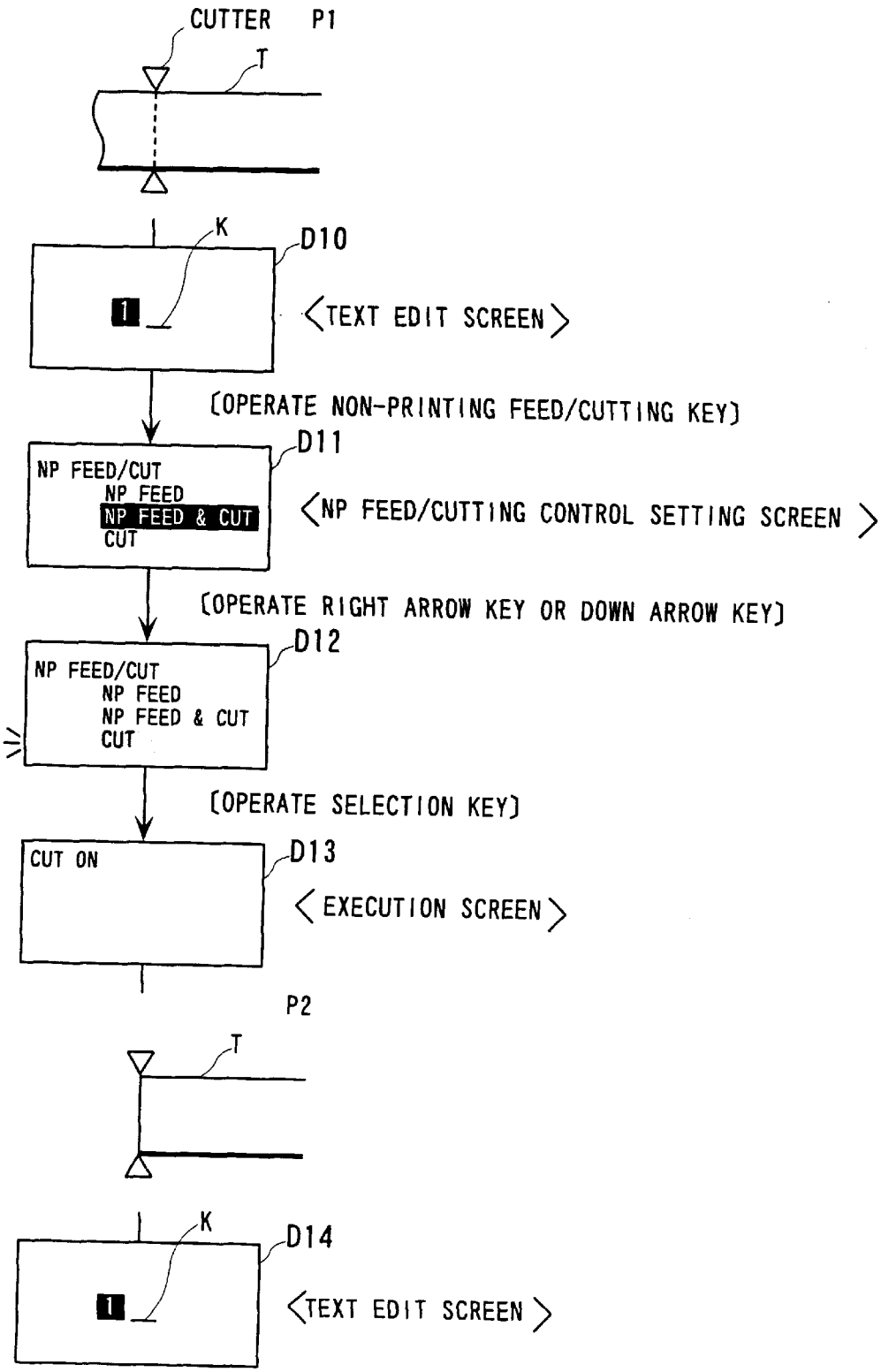
FIG. 3 is a diagram showing an example of a sequence of screens displayed during a process for setting a cutting control mode, which is useful in explaining a typical operating procedure for execution of the process, and changes in the positional relationship between a tape and a cutter caused by the operating procedure.

The label-making apparatus and method according to the invention is implemented mainly by the control block 200, the operating block 11, the cutter block 13, and the tape feeder 15. Now, operations of the apparatus 1 characterizing the present embodiment, more particularly, non-printing feed/cutting control executed thereby will be described with reference to FIGS. 3 to 5.

First, a tape cartridge 5 containing a tape T having a width, a color and a material desired by the user is mounted in the label-making apparatus 1. Now, let it be assumed that as schematically shown by P1 in FIG. 3, a leading end portion of the tape T has been rolled out to a point forward of the position (hereinafter referred to as the "cutting position") of the cutter (P1: hereinafter, figures showing the relationship between the tape T and the cutting position are referred to as the "P?" (? represents a digit) and reference numerals for the figures are shown only by P?). A screen schematically illustrated immediately under the P1 is a text edit screen with no entry of a character string (screen D10: hereinafter, contents displayed on the display screen 41 of the display 4 are referred to as the "screen D??" (? represents a digit) and the reference numerals for the screens are shown only by D??. Further, a cursor position is indicated by a symbol K).

When the non-printing feed/cutting key is depressed (operated) in the above state, the screen is switched to a non-printing feed/cutting control configuration screen (in FIG. 3 to FIG. 4, indicated by "NP FEED/CUTTING CONTROL SETTING SCREEN"), and a character string "NP FEED/CUT" (non-printing feed/cutting) is displayed in a heading area at the top of the screen. At the same time, character strings "NP FEED" (non-printing feed), "NP FEED & CUT" (non-printing feed & cutting), and "CUT" (cutting) are displayed from top side to bottom side in this order as options indicative of respective modes of the non-printing feed/cutting control. Out of the options, "NP FEED & CUT" is highlighted by default (D11). Here, the option "NP FEED" means feeding the tape T by a predetermined distance (17 mm in this embodiment), and the option "NP FEED & CUT" means feeding the tape T by the predetermined distance and then executing cutting of the tape T. Further, the option "CUT" means execution of only cutting the tape T without feeding the same. In this embodiment, for convenience of description, it is assumed that setting and execution of the control modes are sequentially carried out in the order of "CUT"→ "NP FEED"→"NP FEED & CUT". It should be noted that the above modes of the non-printing feed/cutting control are different from a tape feed control and an automatic cutting control associated with printing.

When the right arrow key or the down arrow key is depressed once in the above state of the non-printing feed/cutting control configuration screen (D11), the option "CUT" is displayed in a shaded manner, and caused to blink in this state (D12). Next, when the selection key is depressed, the screen is switched to an "execution screen". On the "execution screen", a character string "CUT ON" (cutting is being executed) is displayed in the heading area at the top of the screen during execution of the cutting control (D13). When the cutting control is terminated, the leading end portion of the tape T which has been located forward of the cutting position is cut off from the tape T (P2). Further, the screen returns to the text edit screen (D14).

Figure 4:
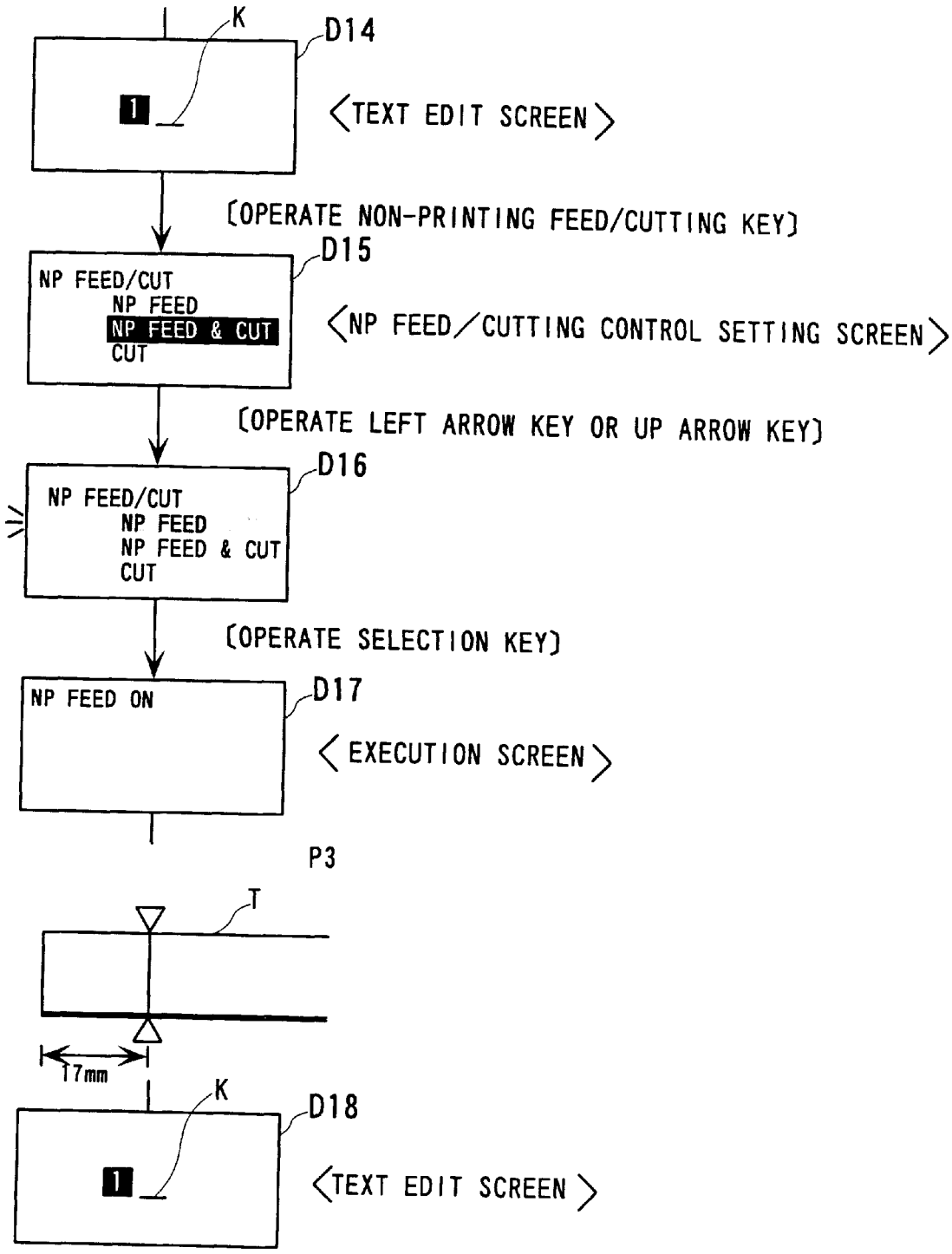
FIG. 4 is a diagram showing an example of a sequence of screens displayed during a process for setting a non-printing feed control mode, which is useful in explaining a typical operating procedure for execution of the process, and changes in the positional relationship between the tape and the cutter caused by the operating procedure.

Next, as shown in FIG. 4, when the non-printing feed/cutting key is depressed from the state of the text edit screen (D14), the screen is switched to the non-printing feed/cutting control configuration screen on which the option "NP FEED & CUT" set by default is highlighted (D15). Now, in order to carry out the non-printing feed control, the left arrow key or the up arrow key is depressed once, whereby the option "NP FEED" is displayed in a shaded manner, and caused to blink in this state (D16). Here, when the selection key is depressed, the screen is switched to an "execution screen". On the "execution screen", a character string "NP FEED ON" (non-printing feed is being executed) is displayed in the heading area at the top of the screen during execution of the non-printing feed control (D17). In the present embodiment, the tape T is fed by 17 mm in each non-printing feed. Further, in the illustrated example, it is assumed that the leading edge of the tape T is located at the cutting position through preceding execution of the cutting control before execution of the non-printing feed control. Hence, the tape T is in a state fed by 17 mm forward of the cutting position (P3), and the cutting control is not executed. Further, the screen returns to the text edit screen again (D18). It should be noted that when the tape T is desired to be fed or extended over a longer distance, the operations carried out from the screens D14 to D17 may be repeated, and the length of the tape to be fed then becomes equal to or value of 17 mm × the number of repetition.

Figure 5:
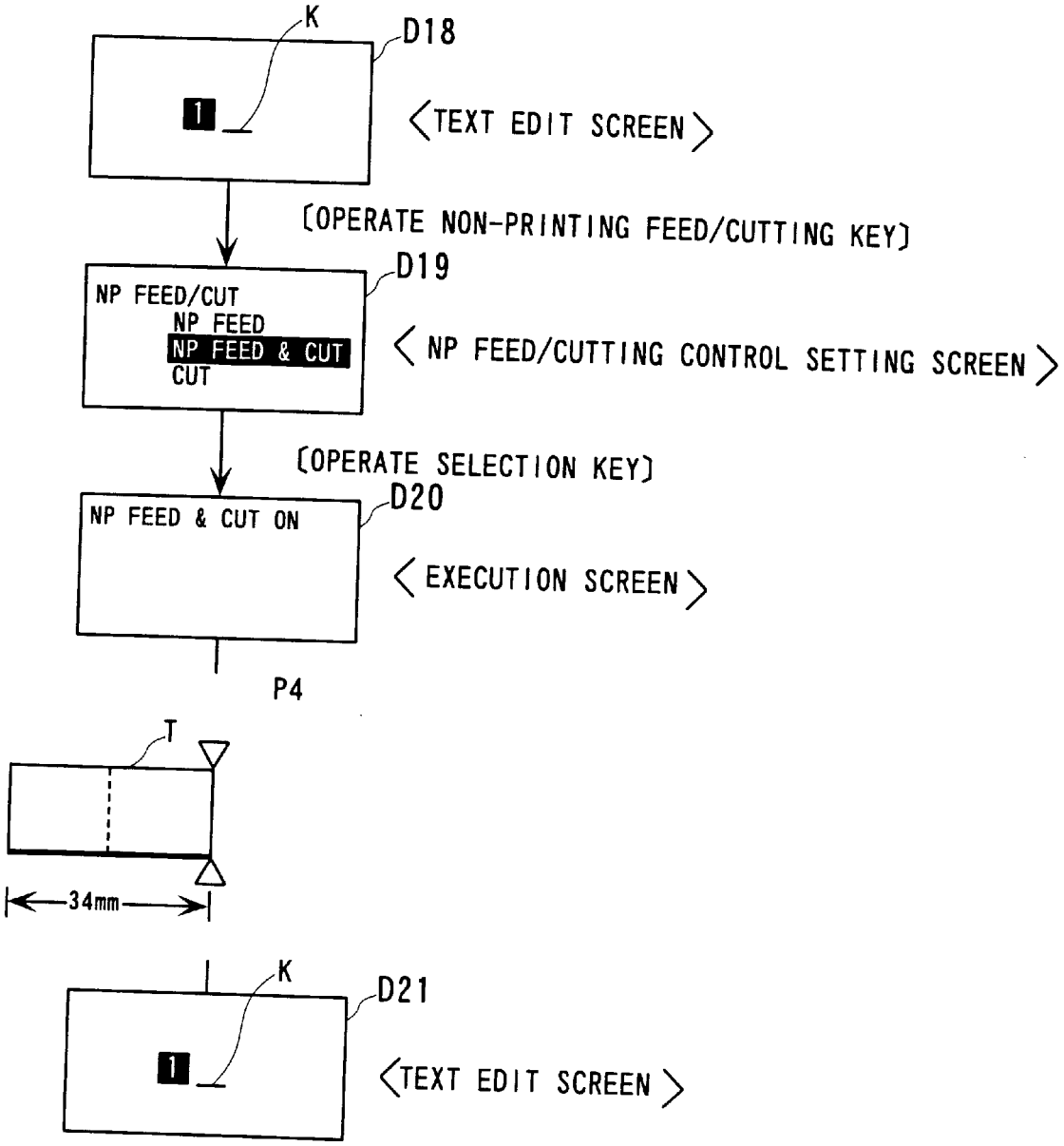
FIG. 5 is a diagram showing an example of a sequence of screens displayed during a process for setting a non-printing feed & cutting control mode, which is useful in explaining a typical operating procedure for execution of the process, and changes in the positional relationship between the tape (label) and the cutter caused by the operating procedure.
Figure 6A:
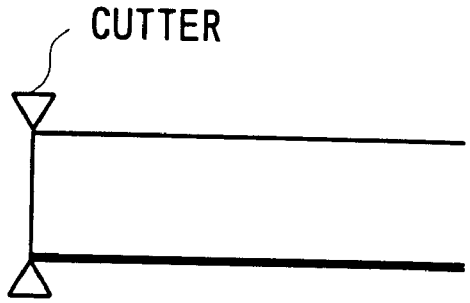
FIGS. 6A to 6C are diagrams useful in explaining changes in the positional relationship between a tape and a cutter.
Figure 6B:
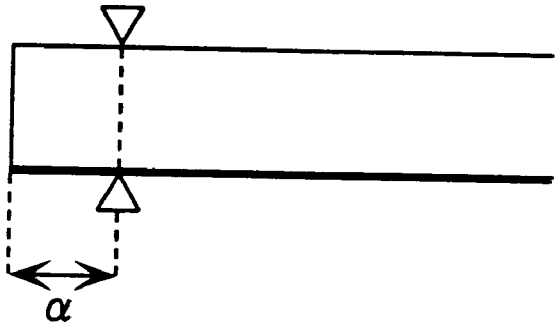
Figure 6C:
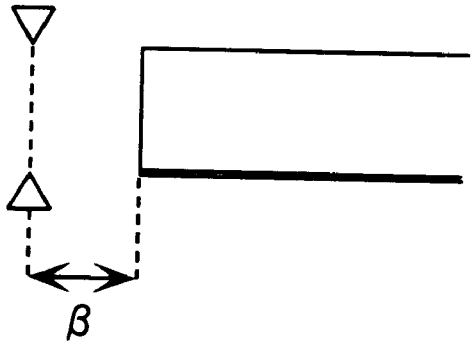

Next, as shown in FIG. 5, when the non-printing feed/cutting key is depressed from the state of the text edit screen (D18), the screen is switched to the non-printing feed/cutting control configuration screen on which the option "NP FEED & CUT" set by default is highlighted (D19). Now, in order to carry out the non-printing feed & cutting control, the selection key is depressed in the above state, whereupon the screen is witched to an "execution screen" (D20). On the "execution screen", a character string "NP FEED & CUT ON" (non-printing feed& cutting is being executed) is displayed in the heading area at the top of the screen during execution of the non-printing feed/cutting control, and after the tape T is fed by 17 mm, the cutting of the tape T is carried out. Here, since the tape T has already been fed by 17 mm by the preceding control (non-printing feed control), the cutting control is carried out in the state of the tape T being fed by 34 mm (17 mm+17 mm), whereby a blank label having a tape length of 34 mm is produced (P4). After completion of the control operation, the screen returns to the text edit screen again (D21).

As described hereinabove, according to the present invention, it is possible to select one of various types of non-printing feed/cutting control, such as a control mode for executing only the non-printing feed operation, a control mode for carrying out a cutting operation after execution of the non-printing feed operation, and a control mode for performing only a cutting operation. This makes it possible to form a label with an accurate length as the user desires as well as a plain label having a predetermined length to be substituted for an adhesive cellophane tape or a tag. Further, in spite of limitation of configurable settings of lengths of the front and rear margins of a label, if the user wants to set a margin longer than the maximum configurable length permitted by the construction of the apparatus, or even if the front and rear margins of a label can be set only to the same length, it is possible to arrange margins with desired lengths forward and rearward of a label by carrying out the non-printing feed.

Although in the present embodiment, the non-printing feed/cutting control has been carried out in a state in which text data is not entered on the text edit screen, this is not limitative, but one of the modes of the control may be carried out after entry of text data.

Further, differently from the non-printing feed/cutting control described of the present embodiment, the apparatus may be configured such that the ON and OFF of the automatic cutting control can be switched before the automatic tape feed and automatic cutting control associated with printing are carried out. In this case, when the automatic cutting control is set to OFF, the cutting control is not carried out although printing of a character string and the automatic tape feed are executed. Instead, after the character string is printed, the non-printing feed control and the non-printing feed & cutting control, described hereinabove are carried out without printing, whereby it is possible to provide a desired margin at a rear portion of the printed tape.

Although it was assumed that the length of the tape T advanced in each non-printing feed is preset to a predetermined value of 17 mm, this is not limitative, but the predetermined value may be varied. Further, a third hierarchical level of option menu may be provided immediately under a second hierarchical level of option menu such that the length of the tape T advanced by a single non-printing feed can be selected at the third hierarchical level, after selecting the option "NP FEED" or option "NP FEED & CUT" via the "non-printing feed/cutting control configuration screen" at the second hierarchical level of option menu.

In the above case, if a leading edge of the tape T happens to be positioned between the printing position and the cutting position, for instance, by setting the non-printing feed length to a value larger than the distance between the printing position and the cutting position, the tape can be advanced forward of the cutting position by a single non-printing feed before printing is carried out. Further, if the non-printing feed length is set to a small value, it can be more finely adjusted although the number of times of non-printing feed operations is required to be increased, and this permits the waste of tape to be reduced when the non-printing feed is carried out only to advance the leading edge of the tape T to the cutting position.

Although in the present embodiment, the options "NP FEED", "NP FEED & CUT", and "CUT" are displayed on the display screen to allow selection of one of them, options are not limited to these three. Further, there is no need to provide all the options. For instance, the label-making apparatus may configured such that it has a function of controlling only the "non-printing feed".

Further, although out of the above three options, "NP FEED & CUT" is set by default, this is not limitative, but an option selected when the control configuration screen displayed on the immediately preceding occasion may be set to a first priority option upon completion of each control operation.

Further, although one of modes of the non-printing feed/cutting control is selected from the "non-printing feed/cutting control configuration screen", dedicated keys may be exclusively provided for setting each mode of the control, on the keyboard.

Additionally, the width and material of a tape may be changed such that a label produced can be substituted for an adhesive cellophane tape, a tag, or a correction tape.

It is further understood by those skilled in the art that the foregoing is a preferred embodiment of the invention, and that various changes and modifications may be made without departing from the spirit and scope thereof.

What is claimed is:

1. A label-making apparatus that is capable of printing an entered character string on a tape as a printing medium while advancing said tape, wherein after printing said entered character string on said tape, the label-making apparatus cuts said tape to a length set beforehand at a predetermined cutting position, thereby making a label, the label-making apparatus comprising:

printing means for printing on said tape;

tape feed means for feeding said tape;

non-printing feed instruction means for instructing non-printing feed of said tape, whereby a non-printing feed operation by said tape feed means is separately carried out independent of operation of the printing means; and control means responsive to a non-printing feed instruction issued by said non-printing feed instruction means, for controlling operation of said tape feed means, such that said printing means is not driven but only said tape feed means is driven to advance said tape by a predetermined length.

2. A label-making apparatus that is capable of printing an entered character string on a tape as a printing medium while advancing said tape, wherein after printing said entered character string on said tape, the label-making apparatus cuts said tape to a length set beforehand at a predetermined cutting position, thereby making a label, the label-making apparatus comprising:

printing means for printing on said tape;

tape feed means for feeding said tape;

cutting means for cutting said tape;

non-printing feed/cutting instruction means for instructing non-printing feed and cutting of said tape, whereby a non-printing feed operation and an operation of the cutting means are separately carried out independent of operation of the printing means; and control means responsive to a non-printing feed/cutting instruction issued by said non-printing feed/cutting instruction means, for controlling operation of said tape feed means, and operation of said cutting means, such that said printing means is not driven but said tape feed means is driven to advance said tape by a predetermined length, and then said cutting means is driven to cut said tape.

3. A label-making apparatus that is capable of printing an entered character string on a tape as a printing medium while advancing said tape, wherein after printing said entered character string on said tape, the label-making apparatus cuts said tape to a length set beforehand at a predetermined cutting position, thereby making a label, the label-making apparatus comprising:

printing means for printing on said tape;

tape feed means for feeding said tape;

cutting means for cutting said tape;

instruction means capable of selectively issuing one of a non-printing feed instruction which instructs non-printing feed of said tape, a non-printing feed/cutting instruction which instructs non-printing feed and cutting of said tape, and a cutting instruction which instructs cutting of said tape; and control means responsive to a selectively issued one of said non-printing feed instruction, said non-printing feed/cutting instruction, and said cutting instruction, for controlling operation of said tape feed means, operation of said printing means, and operation of said cutting means, such that when said non-printing feed instruction is received, said printing means is not driven but only said tape feed means is driven to advance said tape by a predetermined length; when said non-printing feed/cutting instruction is received, said printing means is not driven but said tape feed means is driven to advance said tape by a predetermined length and said cutting means is driven to cut said tape;

and when said cutting instruction is received, neither said printing means nor said tape feed means is driven, but only said cutting means is driven to cut said tape.

4. A label-making method for printing an entered character string on a tape as a printing medium while advancing said tape, and cutting said tape to a length set beforehand at a predetermined cutting position after printing said entered character string on said tape, to thereby make a label, wherein when a non-printing feed instruction which instructs non-printing feed of said tape is issued, said non-printing feed of said tape is carried out by only feeding said tape to advance said tape by a predetermined length without carrying out printing of said tape, and a non-printing feed operation of said tape is separately carried out independent of printing of said tape.

5. A label-making method for printing an entered character string on a tape as a printing medium while advancing said tape, and cutting said tape to a length set beforehand at a predetermined cutting position after printing said entered character string on said tape, to thereby make a label, wherein when a non-printing feed/cutting instruction which instructs non-printing feed and cutting of said tape is issued, said non-printing feed of said tape is carried out by only feeding said tape to advance said tape by a predetermined length without carrying out printing of said tape, and said cutting of said tape is carried out to cut said tape, and a non-printing feed operation of said tape is separately carried out independent of printing of said tape.

6. A label-making method for printing an entered character string on a tape as a printing medium while advancing said tape, and cutting said tape to a length set beforehand at a predetermined cutting position after printing said entered character string on said tape, to thereby make a label, wherein in response to a selectively issued one of a non-printing feed instruction which instructs non-printing feed of said tape, a non-printing feed/cutting instruction which instructs non-printing feed and cutting of said tape, and a cutting instruction which instructs cutting of said tape, if said non-printing feed instruction is issued, said non-printing feed of said tape is carried out by only feeding said tape to advance said tape by a predetermined length without carrying out printing of said tape; if said non-printing feed/cutting instruction is issued, said non-printing feed of said tape is carried out by only feeding said tape to advance said tape by a predetermined length without carrying out printing of said tape, and said cutting of said tape is carried out to cut said tape; and if said cutting instruction is issued, neither said printing of said tape nor said feed of said tape is carried out, but only said cutting of said tape is carried out to cut said tape.

7. A label-making apparatus according to claim 3, further comprising display means displaying options of control modes for executing the non-printing feed operation, carrying out the cutting operation after execution on the non-printing operation and performing only a cutting operation, the display means displaying the control mode during execution, and any one of said control modes being set by default and a control mode being selected when the control configuration screen displayed on the immediately preceding occasion is set to a first priority option of default upon completion of each control operation.

8. A label-making method according to claim 6, wherein options of control modes are displayed for executing said non-printing feed of said tape, carrying out said cutting of said tape after execution of a non-printing operation and performing only a cutting operation, the control mode is displayed during execution, and any one of said control modes is set by default and a control mode is selected when a control configuration screen displayed on the immediately preceding occasion is set to a first priority option of default upon completion of each control operation.

9. A label-making apparatus according to claim 3, further comprising display means displaying options of control modes including a control mode for executing only the non-printing feed operation, a control mode for carrying out a cutting operation after execution of the non-printing feed operation, and a control mode for performing only a cutting operation.

10. A label-making apparatus according to claim 3, further comprising display means displaying a control mode during execution of the control mode.

11. A label-making apparatus according to claim 3, further comprising display means displaying options of control modes, any one of which is set by default, and a control mode option being selected when a control configuration screen displayed on the immediately preceding occasion is set to a first priority option of default upon completion of each control operation.

12. A label-making method according to claim 6, wherein options of control modes are displayed, including a control mode for executing only the non-printing feed operation, a control mode for carrying out a cutting operation after execution of the non-printing feed operation, and a control mode for performing only a cutting operation.

13. A label-making method according to claim 6, wherein a control mode is displayed during execution of the control mode.

14. A label-making method according to claim 6, wherein options of control modes are displayed, any one of which is set by default, and a control mode option is selected when a control configuration screen displayed on the immediately preceding occasion is set to a first priority option of default upon completion of each control operation.

* * * * *